US008020243B2

(12) United States Patent
Hupence

(10) Patent No.: US 8,020,243 B2
(45) Date of Patent: Sep. 20, 2011

(54) ADJUSTABLE HANDLE TOOTHBRUSH

(76) Inventor: Michael J. Hupence, Niskayuna, NY (US)

( * ) Notice: Subject to any disclaimer, the term of this patent is extended or adjusted under 35 U.S.C. 154(b) by 429 days.

(21) Appl. No.: 12/204,187

(22) Filed: Sep. 4, 2008

(65) Prior Publication Data

US 2010/0050353 A1 Mar. 4, 2010

(51) Int. Cl.
*A46B 9/04* (2006.01)

(52) U.S. Cl. ..... 15/144.1; 15/167.1

(58) Field of Classification Search ..... 15/167.1, 15/203, 143.1–144.2
See application file for complete search history.

(56) References Cited

U.S. PATENT DOCUMENTS

| | | | | |
|---|---|---|---|---|
| 4,731,896 | A * | 3/1988 | de La Tour | 15/106 |
| 5,572,763 | A * | 11/1996 | Eguchi | 15/167.1 |
| RE36,407 | E * | 11/1999 | Rocco | 15/110 |
| 6,550,095 | B2 * | 4/2003 | Hawkins et al. | 15/167.1 |
| 6,611,984 | B1 * | 9/2003 | Halm | 15/167.1 |

* cited by examiner

*Primary Examiner* — Laura C Guidotti
(74) *Attorney, Agent, or Firm* — Schmeiser, Olsen & Watts, LLP

(57) ABSTRACT

In a preferred embodiment, this invention provides an easy-to-use, adjustable-head toothbrush that provides two or more locking angles for brushing.

5 Claims, 7 Drawing Sheets

ADJUSTABLE HANDLE TOOTHBRUSH

BACKGROUND OF THE INVENTION

1. Field of the Invention

This invention relates to toothbrushes and more particularly to an adjustable-head toothbrush that provides two or more locking angles of the brush head.

2. Prior Art

Among the thousands of toothbrush inventions are those that adjust into angles. Earlier designs include devices that fold, tilt, allow head-replacement and head-disposal, offer a novelty handle design, and other actions. However there is not yet a non-disposable toothbrush handle that allows the simple, manual angling and angle locking that this proposed construction offers. The following application and patents show adjustable toothbrush devices.

(a) U.S. Pat. No. 4,731,896: a toothbrush which requires finger manipulation of a control pin to adjust a handle that consists of two hinged parts and a pivot. The proposed toothbrush offers three or fewer parts to accomplish the same goal as the previous, control-pin device, which has more parts and is more difficult to operate. The proposed device, because of its simpler construction, allows less-expensive, easier manufacturing plus a simple, one-handed operation.

(b) U.S. Pat. No. 4,829,621: a toothbrush in which the brush-head can be angled. The toothbrush neck may be elastically deformed using an interior flexible wire. An elastically deformable neck does not allow for a locking/secure positioning mechanism, as the proposed one does.

(c) U.S. Pat. No. 4,979,25; a children's toothbrush with a joint, that connects the toothbrush handle with a novelty-handle end. In addition to being a novelty item, the purpose of that device is to fold into a closed unit and/or to lock into place in the open position; it does not offer a method of locking into angled positions.

(d) U.S. Pat. No. 5,003,658: a folding toothbrush-toothpaste system that does not offer a method of angling.

(e) U.S. Patent Number 20050015907: A bendable toothbrush with an inner core of soft, elastomeric material wholly or partly enclosed within an outer flexible skin of a second polymer material. This toothbrush does not offer the squeeze-adjust angling method of the proposed toothbrush. Instead the user must manipulate only a small area—the head of the brush—making it more difficult to adjust than the proposed invention.

There remains a need for an improved, flexible toothbrush that can be angled into two or more positions and locked into place so that it stays in place while brushing. As such, the principal objects of the present invention are:

1. To provide two or more angles for more focused tooth-cleaning, with the option of a straight head;
2. To allow one-handed operation; and
3. To provide a locking mechanism that keeps the angle in place while brushing.

SUMMARY OF THE INVENTION

The present invention achieves the above objects, among others, by providing, in a preferred embodiment, a flexible toothbrush that can be angled into two or more positions and locked into place so that it stays in place while brushing. This invention is unique in that it offers angling of the brush-head to two or more lockable angles. It also offers a unique squeeze action for angle adjustment. It can be made with or without a soft, co-molded covering over the angling mechanism.

DETAILED DESCRIPTION OF THE INVENTION

In general, the present invention has arisen to mitigate and/or obviate the disadvantages of current toothbrush devices and methods of angling a toothbrush.

These and other objects, features and advantages of the present invention will become apparent by referring to the following description of preferred embodiments. The drawings below are for illustration only. The figure numerals in parentheses refer to the figure in which the element(s) being described are more fully shown. The element(s) may also be shown on other figures.

Figure 1:
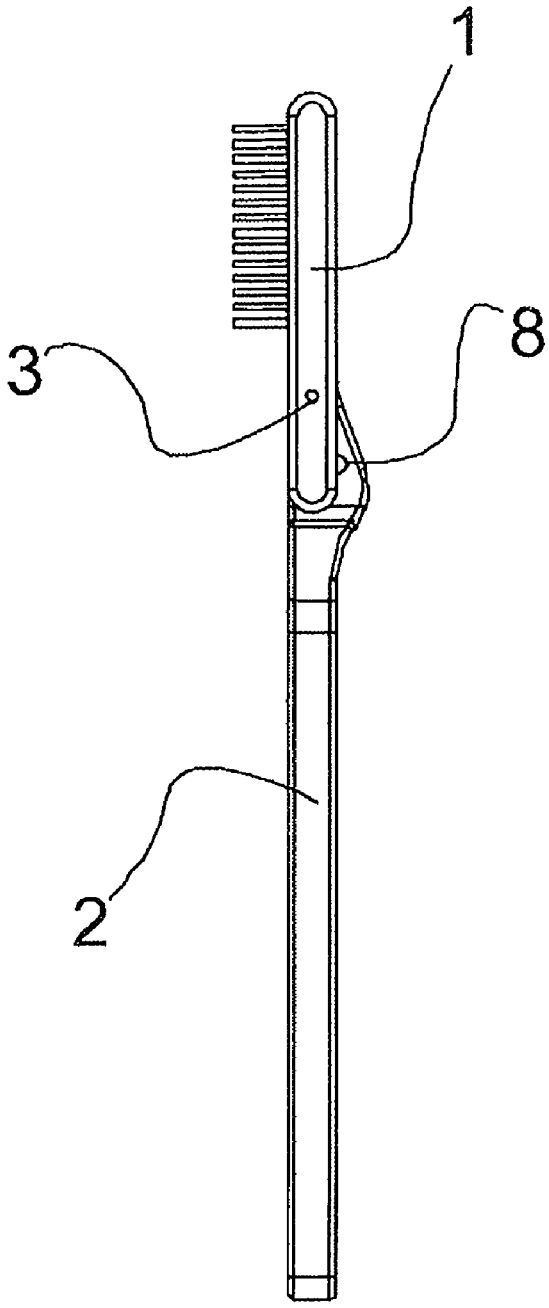
FIG. 1 is a side view with marked head, hinge pin, dimple, and the handle
Figure 2:
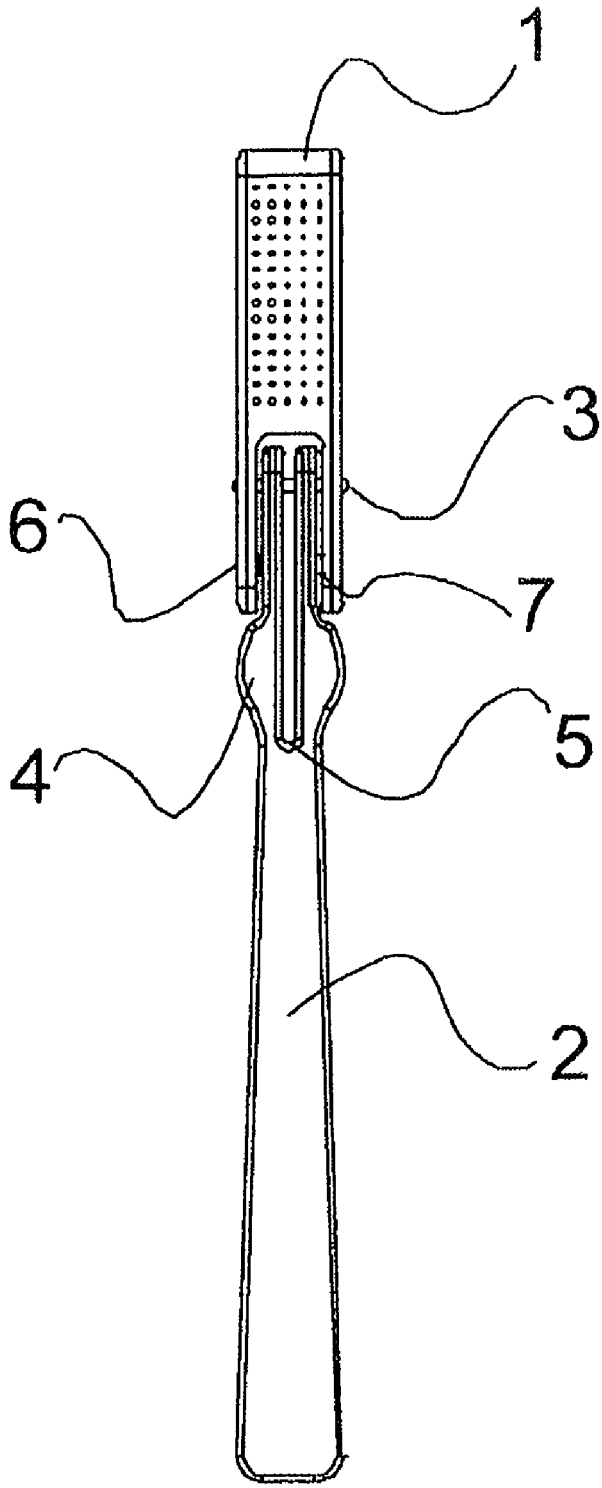
FIG. 2 is a rear view with head, handle, hinge pin, squeeze handle, split for flexing, leg of toothbrush head, and detent
Figure 3:
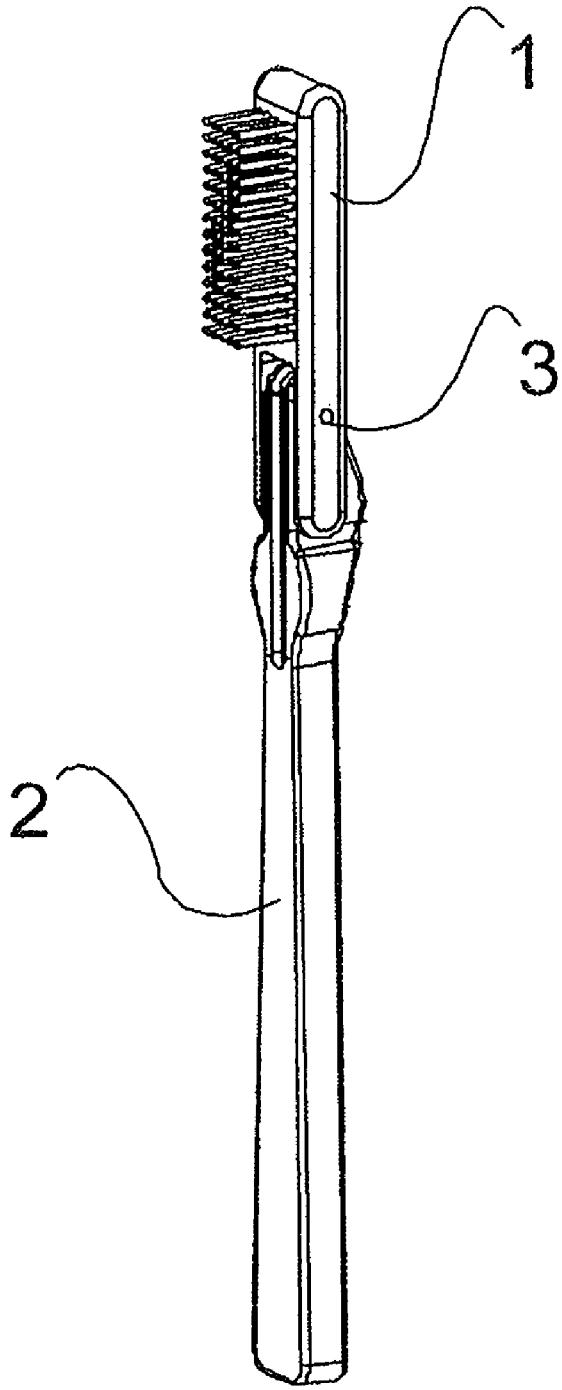
FIG. 3 is a three-quarter view with brush head, handle and hinge pin
Figure 4:
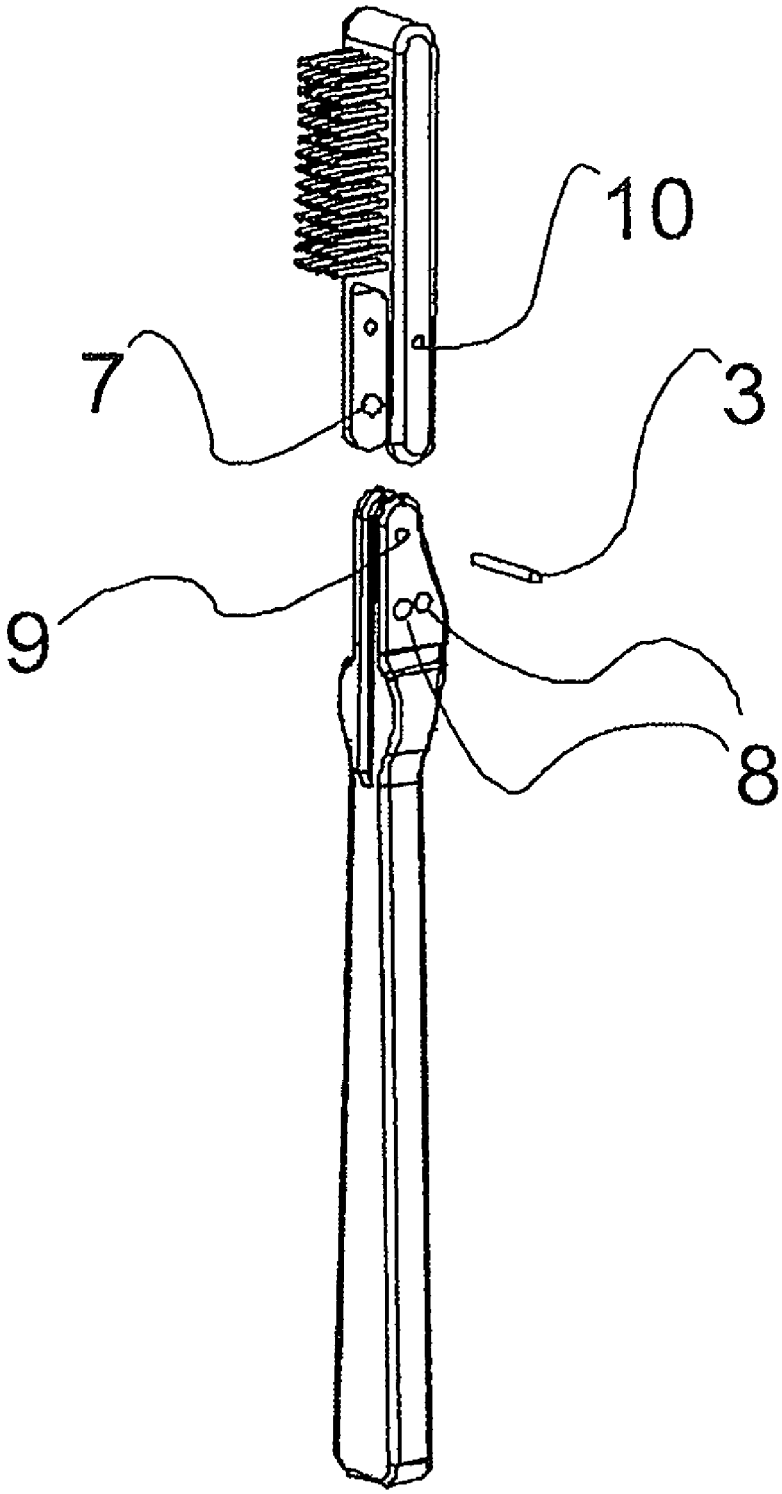
FIG. 4 is a disassembled view with hinge pin, detent, dimple, hole in handle for hinge pin, hole in brush head for hinge pin
Figure 5:
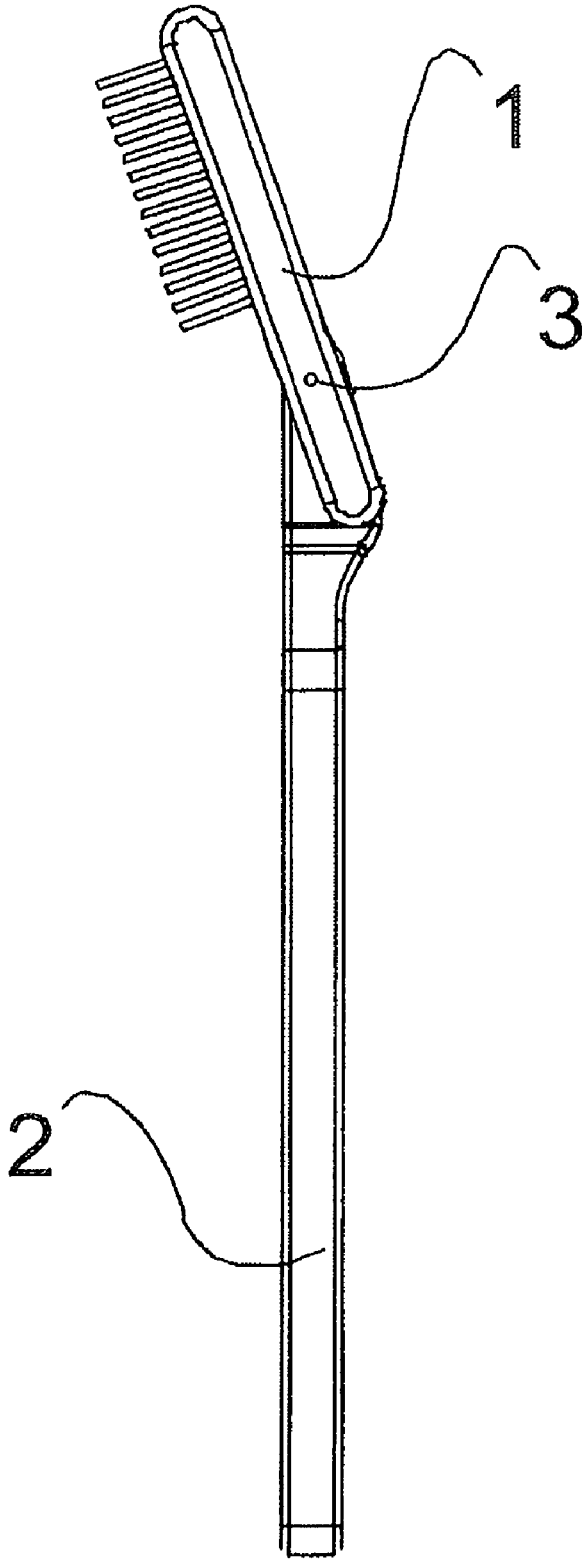
FIG. 5 is a side view with brush head, handle and hinge pin
Figure 6:
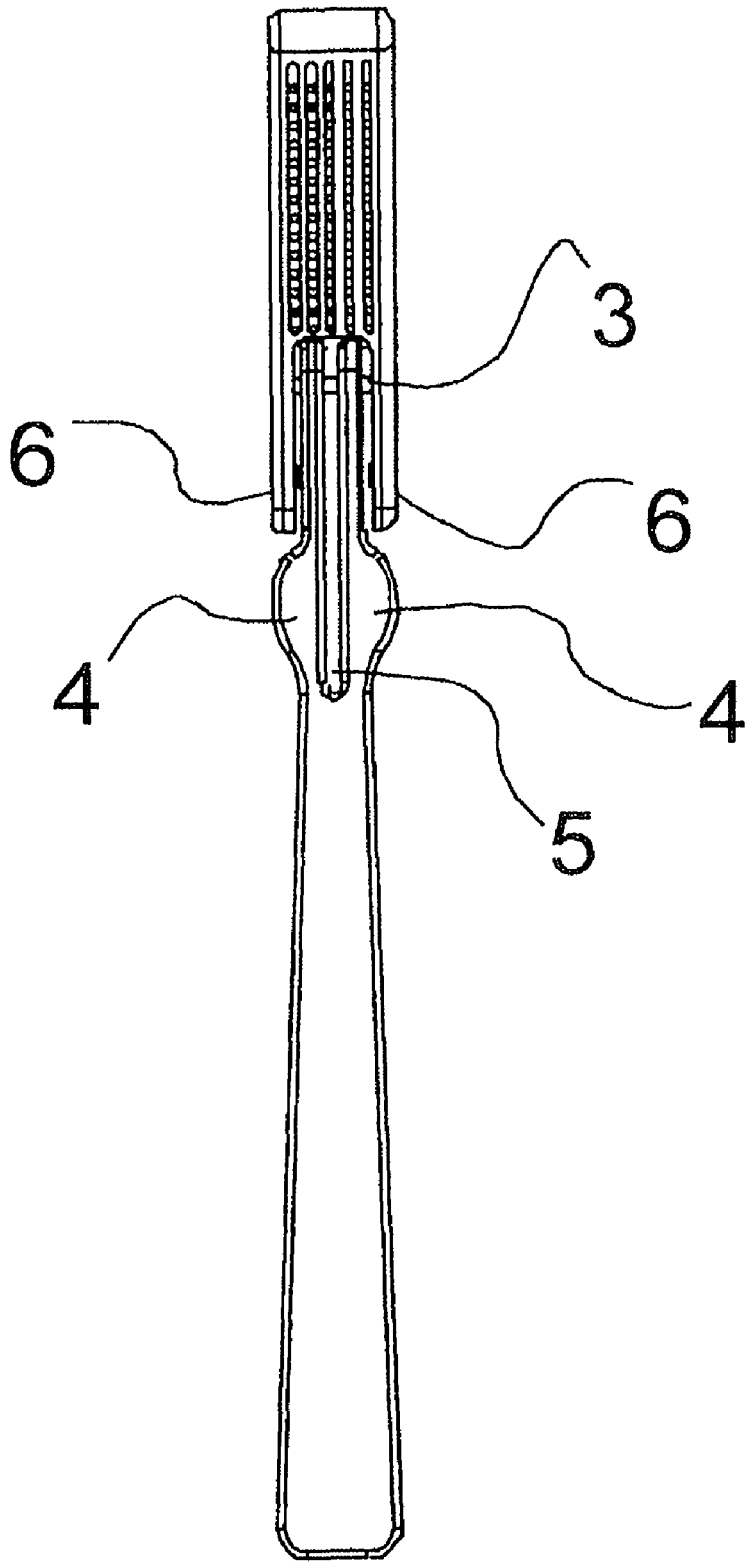
FIG. 6 is a front view with hinge pin, squeeze handle, split for flexing handle segment, and legs of brush head.
Figure 7:
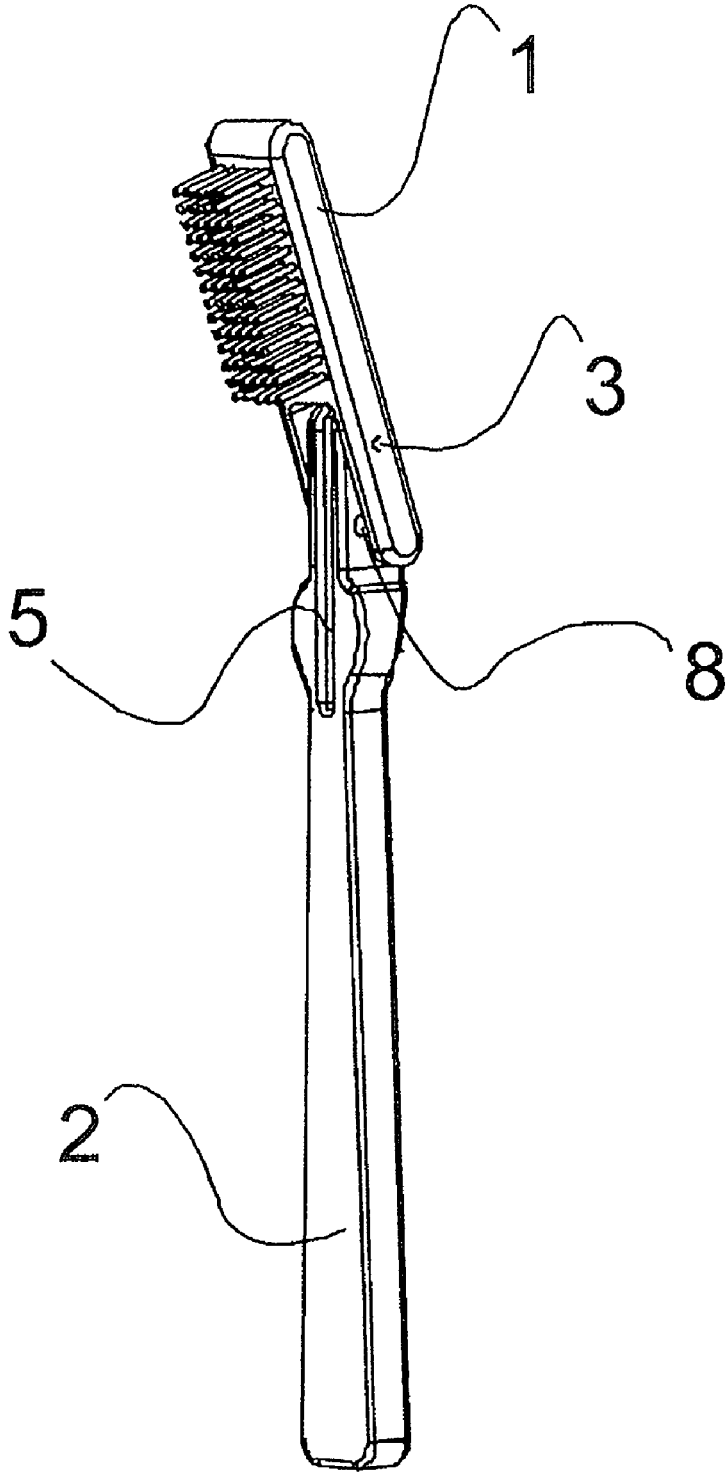
FIG. 7 is a three-quarter view with brush head, hinge pin, handle, split for flexing handle segment, and dimple.

In FIGS. 1 through 7, the toothbrush head 1 connects to the handle via a stationary hinge pin 3 plus a set of detents 7 on either side of the head that lock into a set of dimples 8 on either side of the handle 2. The detents 7 are located on the inside of two opposing legs 6 of the toothbrush head. The detents 7 in the legs 6 fit into the dimples 8 in the handle.

The toothbrush head 1 has a hole 10 in it for the hinge pin 3. The handle also has a hole 9 for the hinge pin 3. The squeeze handle, (or bulge grip) 4 is partially split 5 to allow the handle segment to move into position.

To operate this device, the user squeezes the bulge grip to allow the toothbrush head to be angled. Squeezing the bulge grip flexes the handle 2, thus closing the gap 5 and allowing the detents 7 to move out of the dimples 8, which frees the toothbrush head to move into the desired angle. When the user lets go of the bulge grip, the handle 2 flexes back to its original position, forcing the detents 7 into either one set of dimples 8 for the straight position, or into another set of dimples 8 (FIG. 7), for an angled position.

Since certain changes may be made in the above construction without departing from the scope of the invention, it is intended that everything contained in the above description or shown on the accompanying drawing figures shall be interpreted as illustrative only and not in a limiting sense.

What is claimed is:

1. A flexible toothbrush comprising:

a toothbrush head, the toothbrush head having opposing legs spaced apart from each other, wherein one or more detents are located on an inside surface of each of the opposing legs; and a handle configured to connect to the toothbrush head, the handle being partially split to define a gap when the toothbrush head is connected to the handle, wherein the handle includes:

one or more dimples on an outer surface of the handle configured to fit in the one or more detents, further wherein a location of one or more detents correspond to a different position of the toothbrush head, and a flexible bulge grip, wherein squeezing the flexible bulge grip partially closes the gap to allow the toothbrush head to move into the different positions corresponding to a location of the one or more dimples;

wherein at least one of the dimples is forced into at least one of the detents when the flexible bulge grip is released after squeezing to lock the toothbrush head into position.

2. The flexible toothbrush of claim 1, wherein the different positions of the toothbrush head include at least one angled position and a straight position.

3. The flexible toothbrush of claim 1, wherein the flexible toothbrush offers a unique, easy-to-use squeeze action for angle adjustment, constructed with a soft, co-molded covering.

4. The flexible toothbrush of claim 1, wherein the flexible toothbrush is constructed without a soft, co-molded covering.

5. The flexible toothbrush of claim 1, wherein a stationary hinge pin connects the toothbrush head to the handle.

* * * * *